United States Patent [19]

Kurosawa

[11] Patent Number: 4,844,319

[45] Date of Patent: Jul. 4, 1989

[54] MECHANISM FOR CUTTING STAPLE LEGS IN A STAPLER

[75] Inventor: Mitsuteru Kurosawa, Tokyo, Japan

[73] Assignee: Mac Company, Ltd., Japan

[21] Appl. No.: 115,956

[22] Filed: Nov. 2, 1987

[30] Foreign Application Priority Data

Oct. 31, 1986 [JP] Japan ..... 61-167512[U[

[51] Int. Cl.[4] ..... B27F 7/23

[52] U.S. Cl. ..... 227/79; 227/155; 227/156

[58] Field of Search ..... 227/79, 155, 156

[56] References Cited

U.S. PATENT DOCUMENTS 3,141,492 7/1964 Petree et al. ..... 227/79 X
4,199,095 4/1980 Yamanoi ..... 227/155 X
4,378,085 3/1983 McVeigh ..... 227/79

FOREIGN PATENT DOCUMENTS 263636 9/1913 Fed. Rep. of Germany ..... 227/79
492218 2/1930 Fed. Rep. of Germany ..... 227/79
494484 3/1930 Fed. Rep. of Germany ..... 227/79

*Primary Examiner*—Paul A. Bell
*Attorney, Agent, or Firm*—Cushman, Darby & Cushman

[57] ABSTRACT

A stapler in which staple legs extending through the material to be bound by more than a given length are cut by cooperation between a movable and fixed cutting member. The movable member is moved in a direction orthogonal to the penetrating direction of the staple legs by rotation of a cam which also causes a driver to drive the staple through the material and also clinches the cut staple legs.

8 Claims, 7 Drawing Sheets

MECHANISM FOR CUTTING STAPLE LEGS IN A STAPLER

BACKGROUND AND SUMMARY OF THE INVENTION

The present invention relates to a mechanism for cutting extra portions of staple legs which penetrate a material to be bound and protrude from the underside thereof.

Materials to be stapled have a variety of thicknesses, but staple leg length cannot as a practical matter be varied. Hence, the length of the staple legs must be set to the maximum thickness of the material to be stapled. Thus, if the staple legs are substantially longer than the thickness of the material, the staple legs often penetrate the material and further repenetrate it from the underside thereof even to such an extent that the legs are partly exposed from the surface thereof.

In order to prevent this, there has been proposed a stapler including a mechanism for cutting the extra portions of legs if the staple legs are too long. A well known stapler of this kind is disclosed in, e.g., Japanese Patent Laid-Open Publication No. 102301/1982. As illustrated in FIG. 4 of this Patent Laid-Open Publication, the unnecessary portions of the staple legs after penetrating the material are cut by movable cutting edges 71 and 72 and fixed cutting edges 73 and 74. At this time, the staple legs are clinched simultaneously when being cut because a movable clincher is formed with the movable cutting edges 70 and 71.

However, with such a movable clincher, accuracy must exist between the two movable cutting edges of the movable clincher which respectively make a circular motion and the one fixed cutting edge. This takes much labor to set the dimensions of parts, process the parts and assemble them. In addition, unfavorable conditions both in cutting and in the clinching are apt to be created, since the timing between movements of the two movable edges is critical.

This kind of stapler is further provided with means for processing the cut-scraps in order to prevent problems such as gear scuffing and damage to circuit substrates caused by short-circuits from scattered cut-scraps. One approach is to suck in the cut-scraps by air into a storage. It is not, however, economical to employ an effective power source such as air or the like for processing the cut-scraps.

These problems are overcome in the present invention in which legs are cut in a stapler which is capable of securely and sequentially driving the staple into the material, cutting the staple legs if the staple legs passing through the material exceed a predetermined length, and clinching.

According to another aspect of the invention, the cut-scraps of the staple legs are disposed of without making use of any special power source.

For the purpose of solving the above-mentioned problems, the stapler of the present invention includes a movable cutting member provided underneath a pair of movable clinchers, this movable cutting member being movable in a direction substantially orthogonal to the penetrating direction of the staple legs and including a staple receiving portion formed with first cutting edges engaging with the staple legs penetrating the material, and a fixed cutting member disposed in the forward direction of movement of the movable cutting member, this fixed cutting member having a second cutting edge for cutting the staple legs in cooperation with the first cutting edges of the movable cutting member and a guide portion for guiding the movement of the movable cutting member.

As explained earlier, the staple legs are cut by a movable cutting member which has received the staple legs after penetrating the material. The cutting member moves in the direction orthogonal to the penetrating direction of the staple legs while being guided by a guide portion of a fixed cutting edge. The first and second cutting edges cooperate to cut the staple legs just when the first cutting edges of the movable cutting member touch and pass by the second cutting edge of the fixed cutting member. Subsequently, movable clinchers are actuated, thereby obtaining a fine binding condition in which staple legs cut to an appropriate length are clinched.

In this way, the staple legs penetrating the material are cut separately from clinching, and the movable clinchers have no connection with the cutting effected on the staple legs. For this reason, the movable and fixed cutting members may assume their own configurations and adopt structures which are suitable only for cutting the staple legs. It is therefore possible to securely eliminate the above-mentioned unfavorable conditions in cutting and clinching.

More particularly, in the detailed embodiment two parts of cams have a given relative positional relation with respect to a drive shaft, one pair of cams engaging with one end of drive links each in turn having its central portion pivotally secured to a machine frame and the other end thereof connected to a holder for holding a staple driving member. The other pair of cams engage with cam links for driving a movable cutter for cutting the staple legs in association with a fixed wall member to cut the extra portions of the staple legs penetrating the material, the extra portions exceeding a predetermined length. A clincher link having its one end provided with a clincher press part is pivotally attached to the cam links, one end thereof being loosely fitted in the movable cutter. The movable clinchers for clinching the staple legs are axially supported on the fixed wall member, these movable clinchers being disposed above the clincher press part of the clincher link.

As discussed above, according to the present invention, upon actuation of the drive shaft, the two cams begin to rotate, and the holder causes the staple driving member to drive in the staple by dint of the rotation of one of the cams. As a result, the staple legs penetrate the material. The cam links are then operated by the other type of cams to actuate the movable cutter. If the staple legs passing through the material exceed the predetermined length, these extra portions are cut by the cutter in cooperation with the fixed cutter member. Subsequently, the cam links are operated, resulting in elimination of clearance caused by the loose fitting. Then the clincher link is operated together with the movable cutter, and the clincher press part is driven to rotate the movable clincher, thereby clinching the staple legs.

The cut-scraps of the staple legs in the stapler according to the present invention are disposed by a chute receiving cut legs and extending to an end and a closing member for closing the lower end opening by dint of gravity and pivotally secured to the lower end opening of the chute. Since the lower end opening is closed by the closing member, the cut-scraps are accumulated in the chute. However, the closing member can be easily pivoted to open the lower end opening, thus discharging the cut-scraps outside the chute in a simple manner.

As is obvious from the description given above, the present invention provides an excellent effect in practical use wherein the cut-scraps of the staple legs can simply be discharged and eliminated without requiring a special power source.

DETAILED DESCRIPTION OF THE INVENTION

Figure 1:
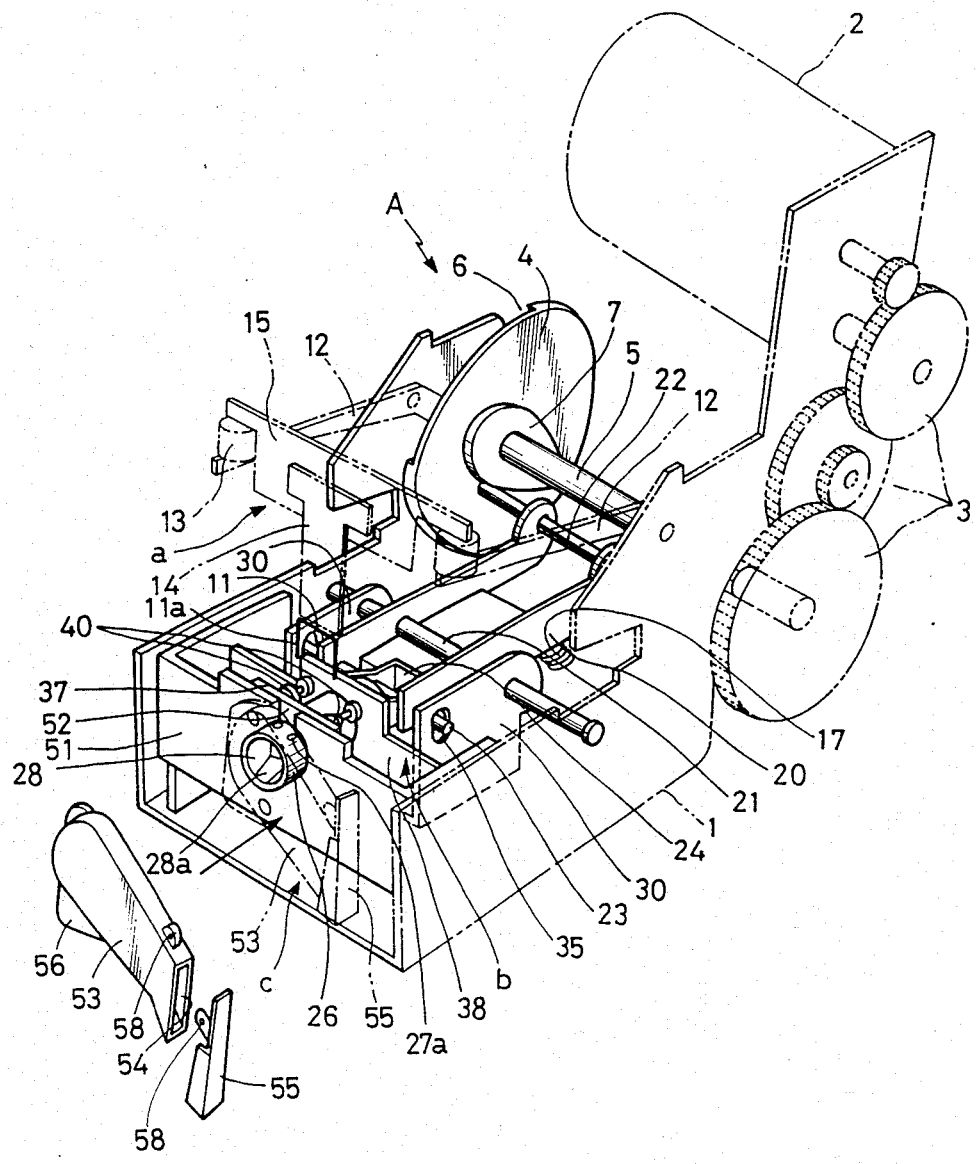
FIG. 1 is a schematic perspective view of the principal portion of a stapler, illustrating a staple leg cutting mechanism according to the present invention in association with a staple clinching mechanism.

Turning attention now to FIG. 1, a stapler generally indicated at A includes a machine frame 1 with an electric motor 2, reduction gears 3 and an drive shaft 5 equipped with cam members 4 provided on both ends thereof. Each cam member 4 includes a first groove cam 6 disposed on the outside and a second cam 7 disposed on the inside, the first cam 6 being linked to a mechanism for driving a staple, and the second cam 7 being linked to a mechanism for cutting the staple legs and to a clinching mechanism.

Figure 3:
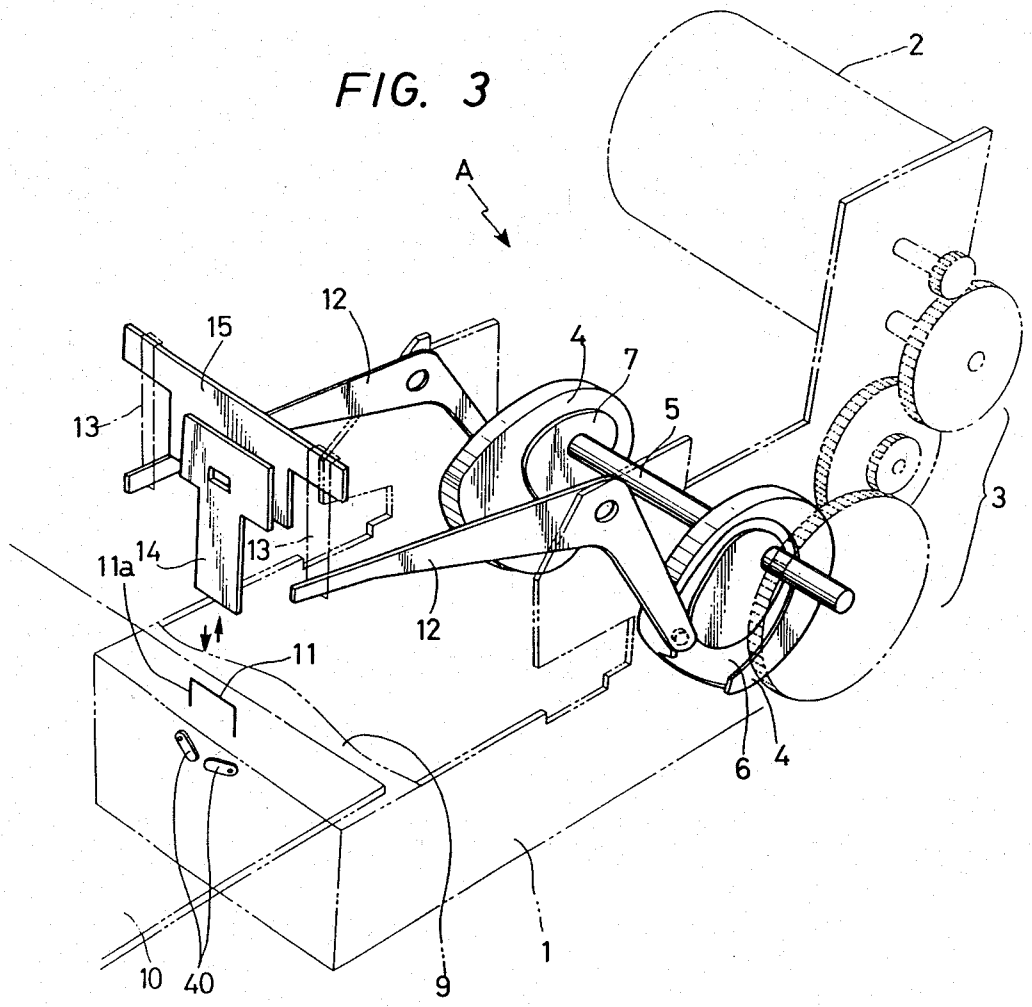
FIG. 3 is a perspective view of the principal portion of a staple driving mechanism of the stapler.

The staple driving mechanism a, as illustrated in FIG. 3, serves to drive a staple 11 into material 10 to be bound which is loaded on a binding board 9 disposed in front of the machine frame 1. One end of drive links 12 engages with the first cam 6, while the center portion is pivotably mounted to frame 1. The other ends of the drive links 12 are linked through spring members 13 to a holder 15 for holding a staple driving member 14. The electric motor 2 is operated to rotate the cam members 4, thereby swinging the drive links 12. The holder 15 secured to the one ends of the drive links 12 is lowered to drive staple legs 11*a* into the material 10 placed on the binding board 9, the staple being supplied from a conventional magazine (not shown) onto the binding board. After penetration of the staple, the holder 15 is then raised. Immediately after driving the staple 11, this staple is clinched by movable clinchers 40 operated by the clinching mechanism which will be described hereinafter. The material 10 is thus bound.

It should be noted that a driving mechanism of this kind is fully described in Japanese Utility Model Application No. 50665/1985.

The staple 11 which has been driven into the material 10 by means of staple driving member 14 is then clinched by a staple clinching mechanism. At this time, if the material 10 is thin and the amount of protrusion of the staple legs 11 is large, the extra portions are cut to a proper length by the staple leg cutting mechanism. The staple clinching mechanism and the staple leg cutting mechanism are constructed as follows.

Figure 2:
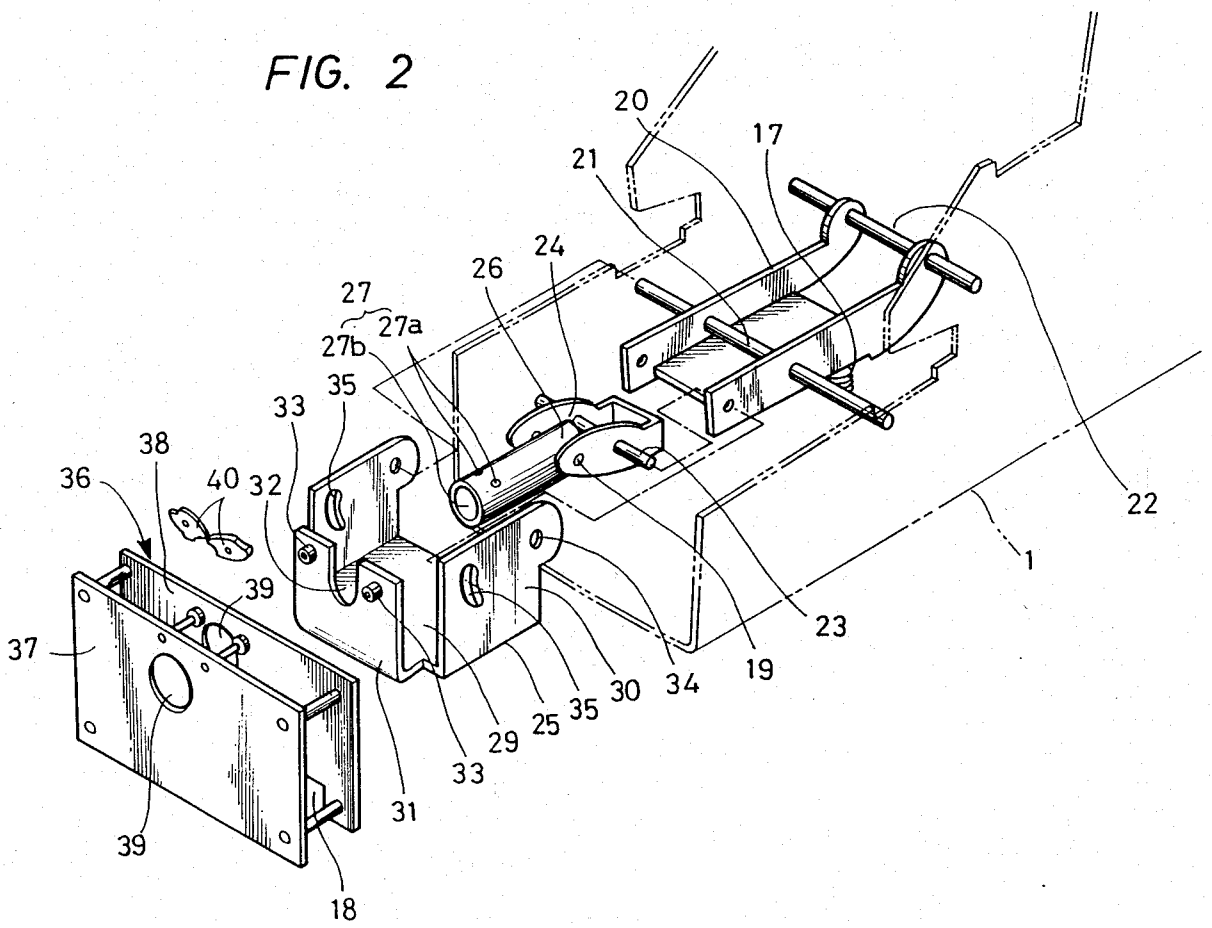
FIG. 2 is an exploded perspective view illustrating the staple leg cutting mechanism and the clinching mechanism.

As seen from FIGS. 1 and 2, cam links 20 engage with the second cams 7 of the cam members 4. Each of the cam links 20 is rotatably supported on a support shaft 21 provided roughly in the center of the machine frame 1. The cam links 20 are biased by spring members 17 so that an engagement rod 22 provided at the rear ends of the cam links 20 engages with the second cams 7. The front portions of the cam links 20 are connected through a connecting shaft 23 and the support shaft 21 to the rear portions of a cutter link 24 and a clincher 7 link 25, respectively. Each of the second cams assumes a configuration suited to cause the engagement rod 22 disposed in the highest position to rotate downward soon after the driving member 14 has driven the staple into the material 10 upon operation of the drive links 12 by the first cams 6.

Figure 4A:
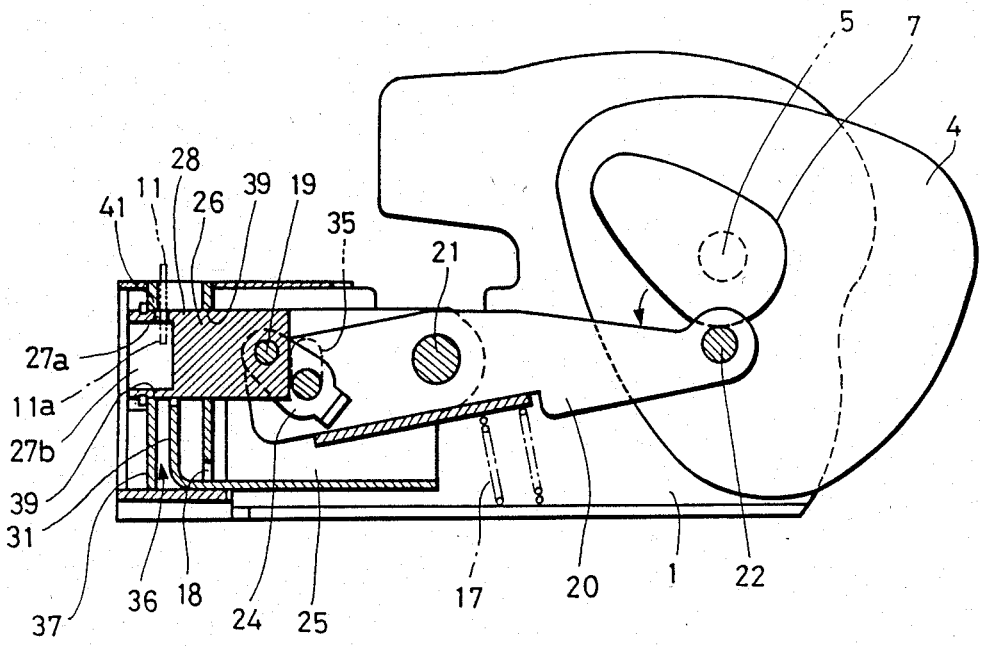
FIG. 4(*a*), 4(*b*) and 4(*c*) are explanatory views each illustrating cutting of the staple leg.
Figure 4B:
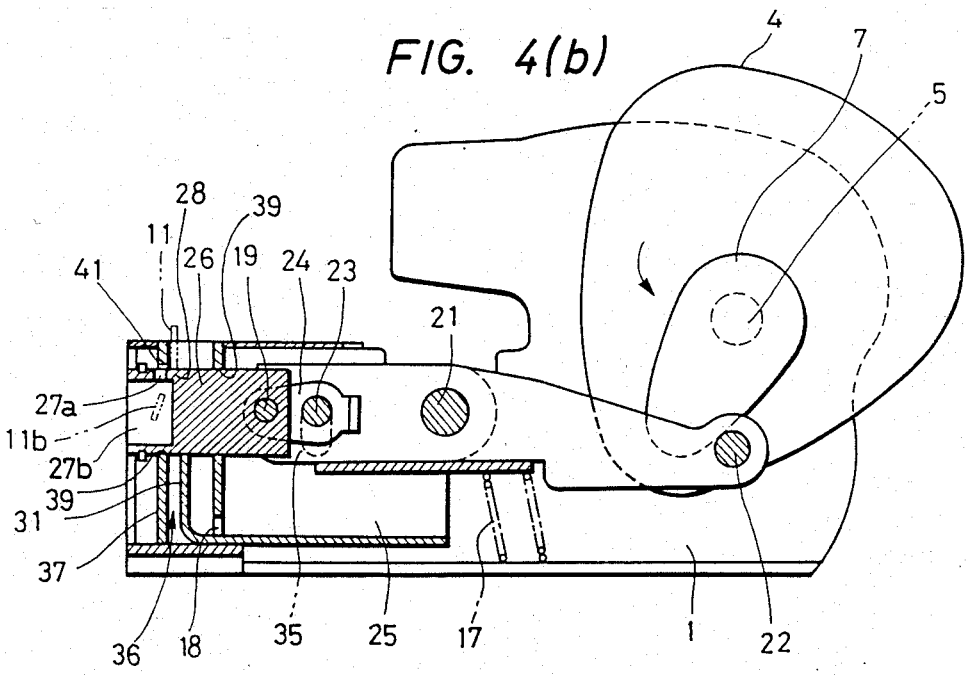
Figure 4C:
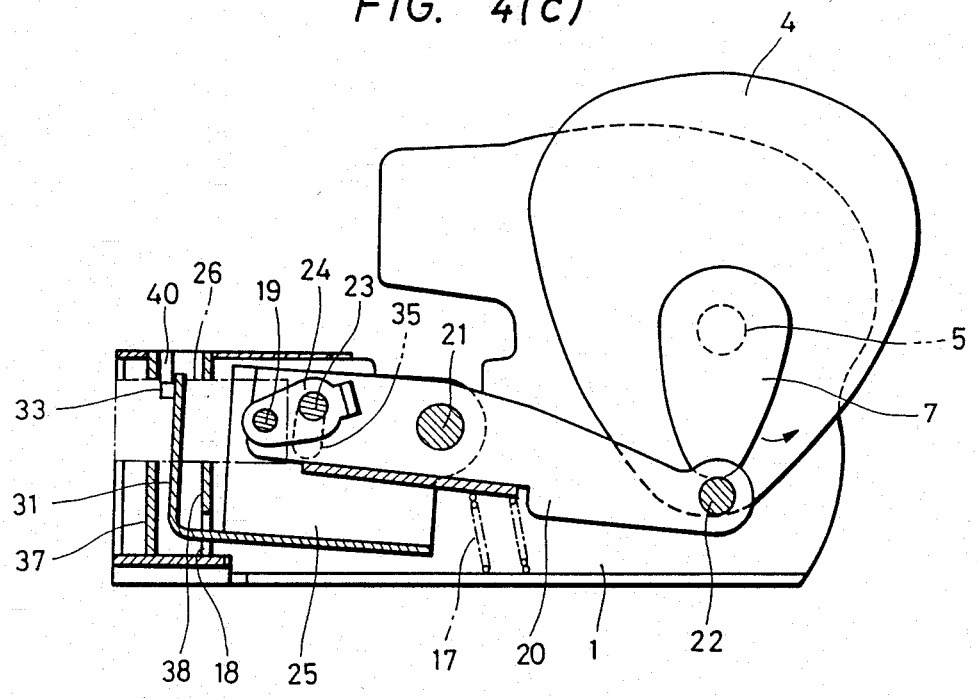

As depicted in FIGS. 4(*a*) through 4(*c*), the cutter link 24 has a substantially U-shape with its front portion connected by the connecting pin 19 to a movable cutting member 26.

The movable cutting member 26 has a cylindrical configuration and includes two holes 27*a* formed in the front upper portion thereof and further an internal bore 27*b*. The holes 27*a* and the internal bore 27*b* are combined to constitute a staple receiving portion 27. The edges of the holes 27*a* serve as cutting edges.

Clincher link 25 has a pair of side plates 30 on either side of a base plate 29. A front plate 31 is vertically provided at the front thereof with notch 32 formed in the center thereof. Bilateral press rollers 33 are provided at the upper portion of the front plate 31. Base plate 29 is usually contiguous to a bottom surface of the machine frame 1. Slots 35 and shaft holes 34 are perforated in the front and rear portions of the side plate 30. The front portions of the cam links 20, the movable cutting member 26 and the cutter link 24 are disposed between the side plates 30 of the clincher link 25. The movable cutting member 26 protrudes through notch 32 of the front plate 31. The support shaft for the cam link 20 is inserted into the rear shaft holes 34, while the front slots 35 receive connecting shaft 23 for connecting the cam links 20 to the cutter link 24.

A fixed cutting member 36 is disposed in front of clincher link 25, and includes holding plates 37 and 38 formed with guide holes 39 for guiding the movable cutting member 26 in a direction substantially orthogonal to the penetrating direction of the staple legs 11*a*, and at the same time movable clinchers 40 are rotatably provided at the upper portion of the front holding plate 37. The fixed cutting member 36 is thus fixed to the machine frame 1. The movable clinchers 40 in combination ordinarily assume a substantially V-shape and are arranged upon the holes 27*a*. The rollers 33 mounted on the press part 31 of the clincher link 25 are positioned below the movable clinchers 40.

Figure 5A:
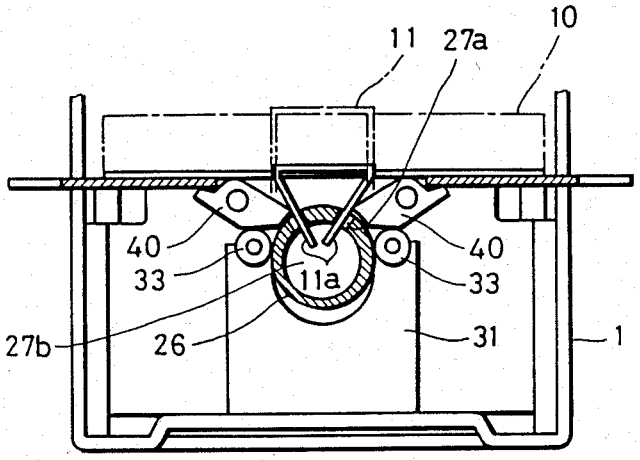
FIG. 5(*a*) and 5(*b*) are explanatory views each illustrating binding.
Figure 5B:
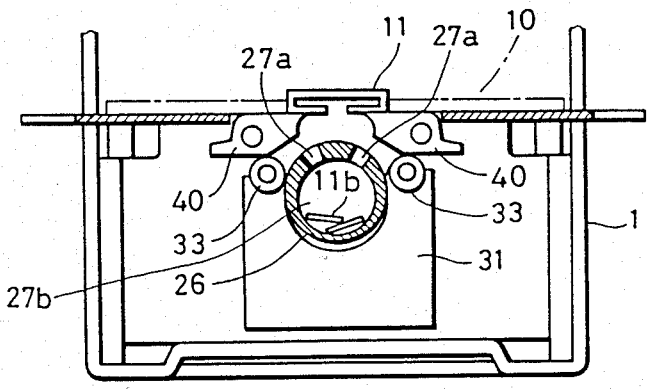

The range in which the movable cutting member 26 moves while being guided by the guide portion 39 is defined both by a position in which the holes 27*a* correspond to the lower portions of the clinchers 40 and by a position in which the first cutting edges rub on the second cutting edge so as to engage therewith, the second cutting edge 41 being constituted by the rear wall circumference of the guide portion 39 of the front holding plate 37. When the holes 27*a* are positioned beneath the movable clinchers 40, which then have a substantially V-shape, the holes 27*a* are arranged to face on the tips of the movable clinchers 40 (see FIG. 5(*a*)).

Figure 8:
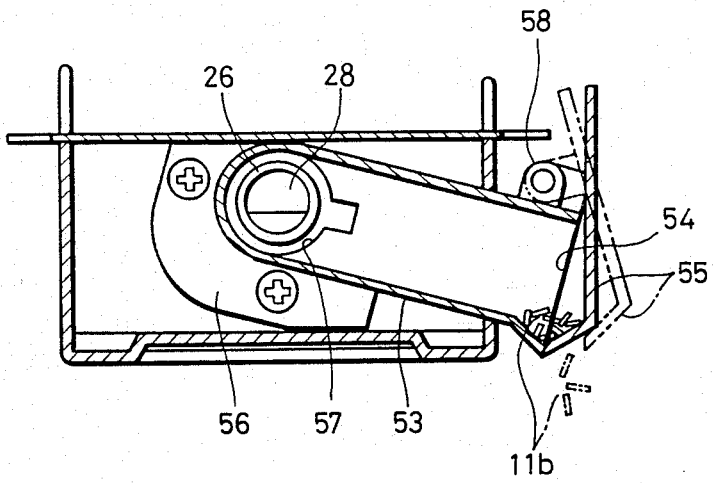
FIG. 8 is a cross-sectional view of a processing device for processing cut-scraps.

A processing device c for processing the cut-scraps of the staple legs is provided at the front portion of a cutting/binding mechanism b (see FIG. 8). This processing device c is constructed as follows. A guide groove of the cut-scrap discharge portion 28 provided at the front end of the movable cutting member 26 is chased in a bracket 51 provided at the front portion of the fixed cutting member 36. A chute 53 is obliquely fixed to the bracket 51 so as to be provided in association with the cut-scrap discharge portion 28. A closing member 55 for closing lower end opening 54 is pivotally secured to this lower end opening and held closed by gravity.

Bag-like chute 53 has its upper end mounted with an installation piece 56 fixed to the front surface of the bracket 51. An opening 57 for receiving the movable cutting member 26 which has cut the staple legs is formed in the upper end side portion thereof. The chute 53 is open at its lower end. The closing member 55 is pivotally attached through a hinge 58 to the lower end opening 54. Usually the closing member 55 closes the lower end opening 54 of the chute 53 by dint of gravity.

The operations of the staple leg cutting/binding mechanism b and the processing device c for processing the cut-scraps will hereinbelow be explained in connection with the rotation of the cam members 4.

Upon rotation of the cam members 4, the drive links 12 are operated by the first cams 6. After the driving member 14 has finished driving the staple 11 into the material 10 to be bound, second cams 7 operate cam links 20. Subsequently, the engagement rod 22 which is, as depicted in FIGS. 4(*a*) and 4(*b*), in the highest position, rotates downward. As a result, the front ends of the cam links 20 move upward, and hence the connecting shaft 23 of the cutter link 24 continuously moves to the upper portion of the slot 35 in the clincher link 25. Then the cutter link 24 is thrust forward, thereby moving the movable cutting member 26. At this time, the staple legs 11*a* have already passed through the material 10 and into the insertion holes 27*a* (see FIG. 4(*a*)). Next, the movable cutting member 26 is, as illustrated in FIG. 4(*b*), operated by actuation of the links 20, thereby moving in the direction substantially right-angled to the penetrating direction of the staple legs 11*a*. The staple legs 11*a* are cut by a cooperative action as the movable cutting member 26 rubs on the fixed cutting member 36. Cut-scraps 11*b* are dropped from an inclined surface 28*a* provided within the discharge portion 28 via the upper end opening 57 of the chute 53 into the lower end opening 54. The lower end opening 54 is closed by the closing member 55, so that the cut-scraps 11*b* are accumulated in the chute 53. It is, however, feasible to simply discharge the cut-scraps 11*b* outside the chute 53 by opening the lower end opening 54 by rotating closing member 55 against gravity. As discussed above, the cut-scrap processing device c is capable of simply discharging and eliminating the cut-scraps of the staple legs with no necessity for any special power source.

Upon rotation of the cam links 20, as shown in FIG. 4(*c*), the clincher link 25 also rotates clockwise, this time about the support shaft 21, whereby the clincher press part 31 is driven to ascend. Then the press rollers 33 permit the movable clinchers 40 to rotate, with the result that the staple legs 11*a* are clinched. The binding process of the material 10 is thus completed.

Based on the above-described link construction, the staple leg cutting mechanism comprises the cam links 20, the cutter link 24, the movable cutting member 26 and the fixed cutting member 36. The staple legs 11*a* penetrating the material 10 to be bound are, as illustrated in FIGS. 4(*a*) and 5(*a*), guided onto the upper surfaces of the movable clinchers 40 by means of the above-mentioned cutting mechanism. The staple legs 11*a* then pass into the holes 27*a*. The movable cutting member 26 is, as depicted in FIG. 4(*b*), operated by the actuation of the links 20 and 24 and moves in a direction substantially orthogonal to the penetrating direction of the staple legs 11*a*. The staple legs 11*a* accommodated in the holes 27 are cut by the cooperative rubbing action of the first and second cutting edges 27*c* and 41.

As seen from FIG. 4(*c*), according to the above-described link construction, the front plate 31 of the clincher link 25 is disposed to be vertically movable between the holding plates 37 and 38 from a lower end slot 18 formed in the rear holding plate 38 of the fixed cutting member 36, while the press rollers 33 are placed to impinge on the undersides of the movable clinchers 40. The front plate 31 is set to move to the lowest position (see FIG. 5(*a*)) in which the press rollers 33 retain the movable clinchers 40 in a substantially V-shape up to the highest position (see FIG. 5(*b*)) in which the press rollers 33 cause the movable clinchers 40 to rotate so as to extend in parallel. As mentioned previously, the staple legs 11*a* penetrating the material 10 impinge on the upper surfaces of the movable clinchers 40 assuming in combination a substantially V-shape and are bent along the upper surfaces thereof. The staple legs 11*a* are clinched at a right angle by turning the movable clinchers 40, interlocking the above-described links.

Next, the operations of the staple leg cutting mechanism and clinching mechanism will be explained in connection with the rotation of the cam members 4.

The cam members 4 rotate, and the drive links 12 are actuated by the first cams 6. After driving member 14 has driven the staple 11 into the material 10, the second cams 7 actuate the cam links 20. As depicted in FIGS. 4(*a*) and 4(*b*), the engagement rod 22 which is in the highest position is turned downward, whereby the front ends of the cam links 20 move upward. Thus, the connecting shaft 23 of the cutter link 24 also moves to the upper portion of the slot 35 of the clincher link 25, and the cutter link 24 is thrust forward to move the movable cutting member 26. At this time, the staple legs 11*a* have already penetrated the material 10 and inserted into the induction holes 27*a*. Therefore, the staple leg cutting mechanism is actuated by moving the movable cutting member 26 while this member 26 is guided by the guide portion 39. The first cutting edges of the movable cutting member 36 cooperate to cut the staple legs 11*a*. Then the cut scraps 11*b* drop into a space formed in the movable cutting member 26 and are discharged outside as described.

If the material 10 is so thick that the staple legs 11*a* cannot reach holes 27*a*, the staple legs 11*a* are not cut.

When the cam links 20 further rotate, as illustrated in FIGS. 4(*c*) and 5(*b*), the clincher link 25 also rotates, this time about the support shaft 21 in a clockwise direction as shown in FIG. 4(*c*), and front plate 31 is driven upward. Thus, the clinching mechanism is actuated, and the movable clinchers 40 are forced to rotate by the press rollers 33. The staple legs 11*a* are thus clinched after these legs 11*a* penetrating the material 10 have been cut, completing binding.

As is evident from the description given above, in the stapler A, the driving process of the staple legs into the material, the cutting process and the clinching process thereof are sequentially performed, separately from each other.

Subsequently, as the cam members 4 rotate further, the holder 15 ascends together with the drive links 12. On the other hand, the movable cutting member 26 recedes. The clincher link 25 descends and reverts to its original position.

Figure 6:
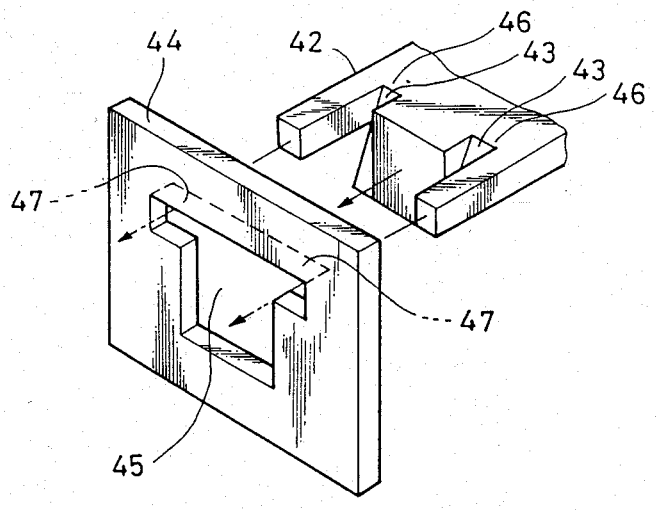
FIG. 6 is an exploded view of the principal portion of another embodiment of the staple leg cutting mechanism.
Figure 7A:
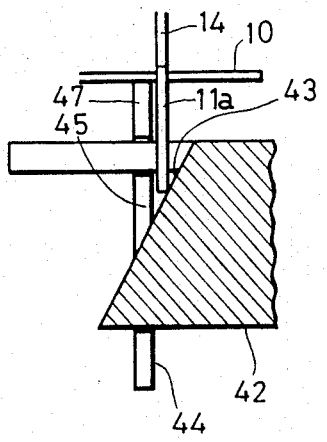
FIGS. 7(*a*) and 7(*b*) are explanatory views each showing cutting.
Figure 7B:
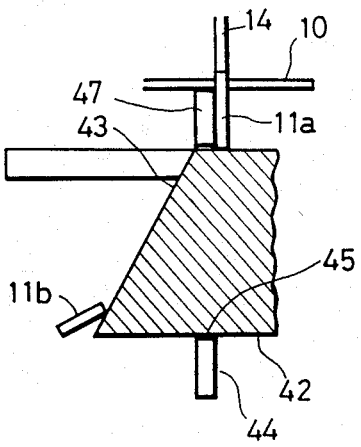

It is to be noted that the constitution of the staple cutting mechanism is not confined to the above-mentioned example. For instance, the following arrangement is permitted. As illustrated in FIGS. 6, 7(*a*), and 7(*b*), a movable cutting member 42 is formed to have T-shape in section, and receiving portions 43 for receiving the staple 11 are provided on both sides thereof. A fixed cutting member 44 is formed with a wall-like configuration, and a guide portion 45 for guiding the movable cutting member 42 is perforated in fixed cutting member 44. The staple legs 11*a* driven into the material 10 by means of the driving member 14 enter the receiving portions 43 of the movable cutting member 42. After this step, the movable cutting member 42 moves while being guided by the guide portion 45 of the fixed cutting member 44. Then the staple legs are cut as they are moved against fixed cutting member 44.

Many changes and modifications in the above described embodiments of the invention can of course be camed out without departing from the scope thereof. Accordingly that scope is intended to be limited by the scope of the appended claims.

What is claimed is:

1. A stapler for binding material with a staple comprising:

means for driving a pair of staple legs through said material;

clinching means for clinching the legs which have penetrated said material; and means for cutting staple legs which extend beyond said material more than a given length before clinching including a movable cutting member having shape which is movable in a direction orthogonal to a plane of a staple to be cut and defining a cut staple leg receiving portion for receiving cut staple legs, said movable cutting member having first cutting edges for engaging said received legs and means for moving said first cutting edges in a direction substantially orthogonal to the penetrating direction of said staple legs, said means for cutting further including a fixed cutting member disposed in the forward direction of movement of said movable cutting member and having a second cutting edge for cutting said staple legs in cooperation with said first cutting edges and a guide portion for guiding the movement of said movable cutting member.

2. A stapler comprising:

a frame;

a motor mounted on said frame;

cam means coupled to said motor to be rotated thereby;

a driver for engaging a staple and driving the staple legs through material to be bound;

first link means connecting said driver to said cam for causing said driver to drive said staple in response to rotation of said cam means;

a movable cutting member having portions for receiving the part of the legs of said staple which extend beyond said material more than a given length, and a first movable cutting edge;

a fixed cutting member mounted to said frame and having a guide portion for guiding movement of said movable cutting member and a second cutting edge;

second link means connecting said cam means to said movable cutting member so that movable cutting member moves in a direction substantially orthogonal to the penetrating direction of said staple legs and said staple legs are cut by cooperation between said first and second cutting edges after said driver has driven said staple legs through said material;

means for clinching said legs; and third link means connecting said cam means to said clinching means for causing said clinching means to move to clinch the staple legs after said movable cutting member has moved.

3. A stapler as in claim 2 further including a chute mounted for receiving, and holding at the lower end thereof, the cut staple legs and including a member normally closing the lower end of said chute and movable for removal of cut staple legs.

4. A stapler as in claim 2, wherein said cam means includes a shaft coupled to said motor, and first and second pairs of cams mounted on said shaft, one of said pairs engaging said first link means and the other of said pairs engaging said second and third link means.

5. A stapler as in claim 2 wherein said movable cutting member has a pair of holes for receiving the portion of said staple legs extending more than said given length.

6. A stapler as in claim 2 wherein said clinching means includes a pair of clinchers pivotably mounted on said fixed cutting member, a clinching member connected to said third link means for vertical movement in response to rotation of said cam means after said movable cutting member has moved, and a pair of rollers mounted on said clinching member for engaging said clinchers to pivot said clinchers and engage said staple legs and clinch said staple legs.

7. A mechanism for cutting staple legs in a stapler, comprising:

a machine frame;

a drive shaft;

two pairs of cams having a given relative positional relation and mounted on said drive shaft;

drive links having their central portions pivotally secured to said machine frame and their one ends engaging with said one pair of cams;

a staple driving member a holder for holding said staple driving member, said holder being connected to the other ends of said drive links;

a movable cutter for cutting said staple legs in cooperation with a fixed wall member in order to cut extra portions of said staple legs penetrating said material, said extra portions exceeding a predetermined length;

cam links for actuating said movable cutter, said cam links engaging with said other pair of cams;

a clincher link provided at its one end with a clincher press part and pivotally secured to said cam links, said one end of said clincher links being loosely fitted in said movable cutter; and movable clinchers, axially supported on said fixed wall member, for clinching said staple legs, said movable clinchers being disposed at the upper portion of said clincher press part of said clincher link.

8. A stapler for binding material with a staple and a processing device for processing cut-scraps of staple legs, in combination, comprising:

means for driving a pair of staple legs through said material;

clinching means for clinching the legs which have penetrated said material;

means for cutting staple legs which extend beyond said material more than a given length before clinching including a movable cutting member having portions receiving staple legs and first cutting edges engaging said received legs, means moving said movable cutting member in a direction substantially orthogonal to the penetrating direction of said staple legs, a fixed cutting member disposed in the forward direction of movement of said movable cutting member and having a second cutting edge for cutting said staple legs in cooperation with said first cutting edges and a guide portion for guiding the movement of said movable cutting member;

a chute member obliquely coupled to said stapler so as to receive portions of said staple legs cut by said means for cutting; and a closing member pivotally coupled to a lower, open end of said chute member for closing said lower end of said chute member.

* * * * *

UNITED STATES PATENT AND TRADEMARK OFFICE

CERTIFICATE OF CORRECTION

PATENT NO. : 4,844,319

DATED : July 4, 1989

INVENTOR(S) : Mitsuteru KUROSAWA

It is certified that error appears in the above-identified patent and that said Letters Patent is hereby corrected as shown below:

Title Page:

Please Change

"(73) Assignee: Mac Company Ltd., Japan" to

--(73) Assignee: Max Company Ltd., Japan --.

Signed and Sealed this

Seventh Day of January, 1992

*Attest:*

HARRY F. MANBECK, JR.

*Attesting Officer*

*Commissioner of Patents and Trademarks*